United States Patent [19]

Buresh et al.

[11] 4,451,103

[45] May 29, 1984

[54] CONNECTOR ASSEMBLY

[75] Inventors: Lloyd V. Buresh, Cedar Rapids; Garth D. Hammond, Marion; Emil J. Koval, Marion; Vernon R. McCormick, Marion, all of Iowa

[73] Assignee: Rockwell International Corporation, El Segundo, Calif.

[21] Appl. No.: 330,370

[22] Filed: Dec. 14, 1981

[51] Int. Cl.[3] ..... H01R 17/04

[52] U.S. Cl. ..... 339/93 R; 339/17 C; 339/126 R; 339/126 J

[58] Field of Search ..... 339/17 C, 126 R, 126 J, 339/126 RS, 93 R, 93 C

[56] References Cited

U.S. PATENT DOCUMENTS

| | | | |
|---|---|---|---|
| 1,982,319 | 11/1934 | Perry | 339/93 R |
| 2,907,976 | 10/1959 | Damon | 339/126 J |
| 2,989,610 | 6/1961 | Linton | 339/126 R |
| 3,052,866 | 9/1962 | Koch | 339/126 J |
| 3,179,912 | 4/1965 | Huber et al. | 339/17 C |
| 3,564,478 | 2/1971 | Hampton | 339/17 C |
| 3,750,090 | 7/1973 | Teman | 339/177 R |
| 3,910,665 | 10/1975 | Stull | 339/17 C |

FOREIGN PATENT DOCUMENTS

| | | | |
|---|---|---|---|
| 1276759 | 10/1961 | France | 339/126 RS |
| 688780 | 3/1953 | United Kingdom | 339/94 A |

*Primary Examiner*—John McQuade
*Assistant Examiner*—Gary F. Paumen
*Attorney, Agent, or Firm*—Richard K. Robinson; George A. Montanye; H. Fredrick Hamann

[57] ABSTRACT

A connector assembly has a retainer that includes a tubular member with a receptacle end, a bushing and a conductor end. The conductor end is inserted through a clearance hole in a plate such as a printed circuit card until the bushing rests in the clearance hole. A connector is placed within the tubular member and held in place by an end cap. The end cap retains the connector in place. Radial float is provided by making the clearance hole through which the bushing is placed larger than the diameter of the bushing. The tubular member is prevented from falling through the clearance hole by retaining protrusions that extend radially outward from the tubular member. Axial float is provided through the use of a bias means such as a foam pad located in the end cap which provides a positive bias to the connector.

8 Claims, 6 Drawing Figures

CONNECTOR ASSEMBLY

The Government has rights in this invention pursuant to contract number N00019-78-C-0501 with the Department of the Navy.

BACKGROUND OF THE INVENTION

The invention relates to tubular connector assemblies, and in particular, to connector assemblies that provide axial and radial float for a tubular connector such as a coaxial connector or a radio frequency (rf) connector.

The mounting or connecting of rf cables such as coaxial cables, to plates such as a circuit card has often created problems due to the requirement of connecting two parallel conductors, a braided shield and a center conductor. Some of the solutions to problems with coaxial connections to and between printed circuit boards are described in U.S. Pat. Nos. 3,179,912 and 3,910,665. The disadvantages with the prior-art-type coaxial connectors is that they are rigidly mounted to a printed circuit card and provide only limited movement. Connections between the connectors must be made very carefully to avoid the opening of the solder joints that retain the connector assembly to the printed circuit board. This limitation requires that the placement of the connector assemblies must be held to very close tolerances and the cables that are connected to the connectors must be secured to prevent movement thereof.

SUMMARY OF THE INVENTION

A connector assembly has a retainer that includes a tubular member with a receptacle end, a bushing and a conductor end. The conductor end is inserted through a clearance hole in a plate, such as a printed circuit card, until the bushing rests in the clearance hole. A connector is placed within the tubular member and held in place by an end cap. The end cap retains the connector in place. Radial float is provided by making the clearance hole through which the bushing is placed larger than the diameter of the bushing. The tubular member is prevented from falling through the clearance hole by retaining protrusions that extend radially outward from the tubular member. Axial float is provided through the use of a bias means such as a foam pad located in the end cap which provides a positive bias to the connector.

There are two embodiments of the tubular member and end cap provided.

It is the object of the invention to provide a connector assembly for a tubular connector which will retain the connector securely to a plate and yet permit easy connection and disconnection of two mating coaxial or tubular connectors.

It is yet another objective of the invention to provide a connector assembly that will provide sufficient axial and radial float to ensure that a rigidly mounted tubular plug can be mated with a connector mounted within the connector assembly.

It is yet another objective to provide a connector assembly which will guide a rigidly mounted connector to an engaged position without damage to either connector while providing full electrical continuity between the dual conductors.

These and other objectives, features and advantages of the present invention will appear more fully from the following description of the preferred embodiments taken in conjunction with the drawings.

DETAILED DESCRIPTION OF THE PREFERRED EMBODIMENT

Figure 1:
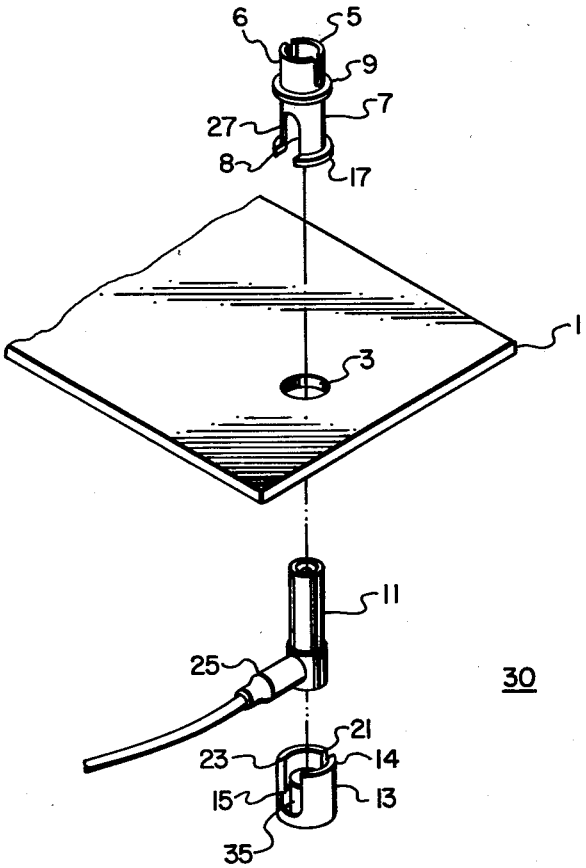
FIG. 1 is a drawing of an exploded connector assembly according to the invention.

In FIG. 1, to which reference should now be made, there is shown a plate 1 which may be a printed circuit card or a chassis panel through which there is drilled a clearance hole 3. A bushing 7 that is part of a sleeve 5 is placed through the clearance hole 3 for the receipt of a receptacle such as a coaxial receptacle 11. An end cap 13 is placed on a conductor end 8 of the sleeve 5 and is held in place by a retaining groove 15 that latches on to a retaining ledge 17. The diameter of the clearance hole 3 is substantially larger than the diameter of the bushing 7 and less than the diameter of a retaining ring 9. Consequently, when the retaining groove 15 is engaged to the retaining ledge 17 the end cap 13 not only retains the coaxial connector 11 in place, but also the bushing 7 is held in place in the clearance hole 3 by the top edge 14 of the end cap 13 and the retaining ring 9. This arrangement allows axial movement of the connector assembly 30. Archways 23 and 27 provide clearance for the conductor 25. Archway 23, additionally, (in conjunction with slot 21) allows the end cap 13 to expand over the retaining ledge 17 when being assembled. Additionally, archway 27 and slot 29 (illustrated in FIG. 3) are on the conductor end 8 of the sleeve 5 and allow compression of the retaining ledge 17 to facilitate the insertion of the bushing 7 through the clearance hole 3. Retaining ring 9 and end cap 13 retain the final assembly in place within the clearance hole 3.

Figure 2:
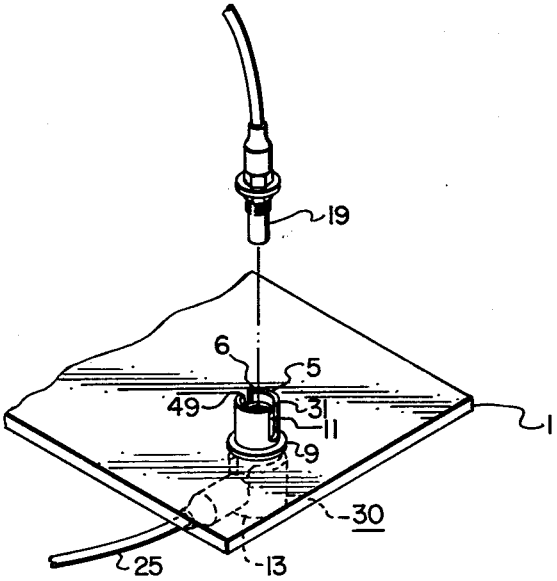
FIG. 2 is a drawing of a mounted connector assembly.

FIG. 2 illustrates the complete assembly of the connector assembly 30 that includes the coaxial receptacle 11 and the sleeve 5 as well as end cap 13. A coaxial plug 19 is inserted into the coaxial receptacle 11. Slots 49 and 31 are designed to allow expansion of a receptacle end 6 of the sleeve 5 for receipt of the coaxial plug 19.

Figure 3:
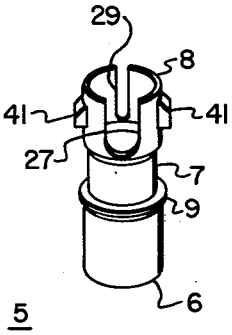
FIG. 3 is a perspective view of a sleeve of the connector assembly according to the invention.
Figure 4:
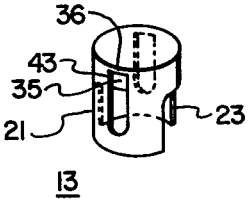
FIG. 4 is a perspective view of an end cap according to the invention.

FIG. 3 shows an alternate embodiment of the sleeve 5 in which the bushing 7 is an indentation in the sleeve 5. The end cap 13 of FIG. 4 is held in place by retaining nodules 41. Archway 27, as well as slot 29, allow compression of the conductor end 8 of the sleeve 5 so that the retaining nodules 41 may pass through the clearance hole 3 of FIG. 1. The end cap 13, shown in FIG. 4, has nodule grooves 43 that will receive the retaining nodules 41 of the sleeve 5 when the cap is placed over the conductor end 8 locking the end cap 13 on the sleeve 5 thereby. The slots 43 are sized to allow axial movement of the end cap 13 over the conductor end 8 of the sleeve 5 while being retained on the sleeve 5 by the retaining nodules 41. A bias means 35 which is a device such as a foam pad or spring is mounted on the inside of the end cap 13.

The sleeve 5 and the end cap 13, in the preferred embodiment, are made from a material that is deformable such as a plastic material.

Figure 5:
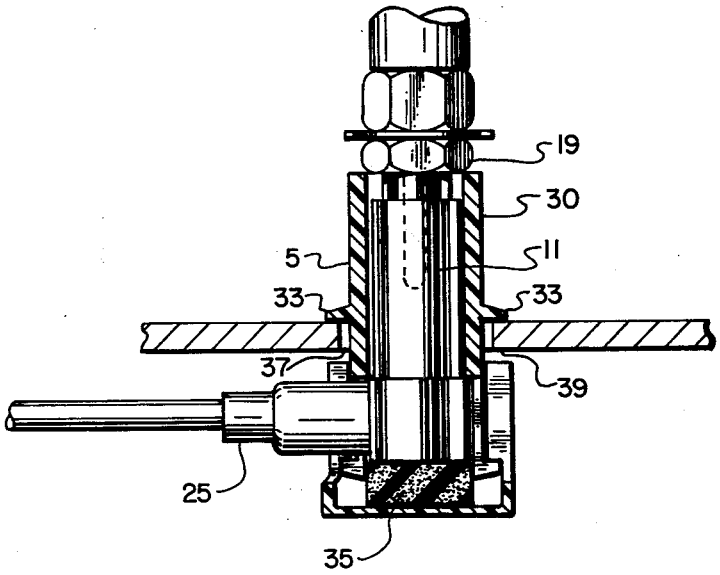
FIG. 5 is a partial section view of the connector assembly according to the invention with connected tubular connectors.

The embodiment in FIG. 1 is the embodiment used when the sleeve 5 and the end cap 13 are machined. However, in large quantities the sleeve 5 and the end cap 13 may be molded. This embodiment is shown in FIGS. 3 and 4 to which reference should now be made. FIG. 5 is a partial sectional view of the assembled unit in which the coaxial plug 19 is engaged to the coaxial receptacle 11. The sleeve 5 is held in place by retaining protrusions 33 which may be nodules or a retaining ring 9. Clearance 37 allows radial movement of the connector assembly 30 and the bias means 35, which is a foam pad in this embodiment, provides a bias against the coaxial receptacle 11 and thereby facilitates axial movement of the coaxial receptacle 11 which is useful during connection of the coaxial plug 19 into the coaxial receptacle 11.

Figure 6:
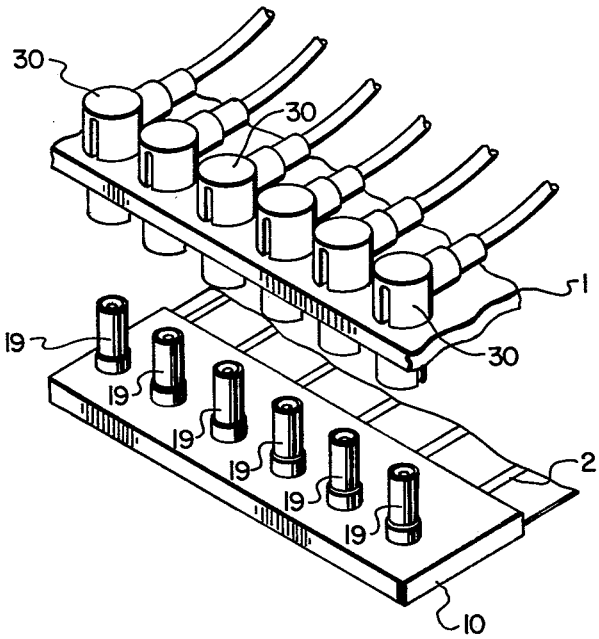
FIG. 6 illustrates the connection to a rigidly mounted tubular plug of the connector assembly according to the invention.

FIG. 6, to which reference should now be made, illustrates a multiple conductor plug arrangement in which there are a plurality of fixed coaxial plugs 19 mounted on a printed circuit card 10 which is connected to a multiconductor cable assembly which may be either a plurality of conductors 2 or a flexprint conductor. Flexprint is defined as a plurality of printed conductors on a flexible surface so that it may serve as a cable. The coaxial connector assemblies 30 are mounted on the plate 1 which may be a printed circuit card or other type of material . The connecting of the cable assemblies to the fixed plugs where movement and versatility of the unit is required is facilitated by the radial and axial float in the connector assemblies 30 on the plate 1.

Many changes and modifications in the above described embodiment of the invention can, of course, be carried out without departing from the scope thereof. Accordingly, the scope is intended to be limited only by the scope of the appended claims.

I claim:

1. A connector assembly for coupling a connector to a plate-like member having opposed sides and an opening through said plate-like member for receiving the connector assembly, the connector assembly comprising:

a first connector member having first and second end portions and an intermediate portion coupled between said end portions along an axis, said intermediate portion being configured to extend through said opening and spaced therefrom to allow movement of said intermediate portion in a radial direction relative to said axis, said first connector member having a tubular configuration and said first end portion being constructed and arranged to receive a tubular first connector element and said second end portion being constructed and arranged to receive a tubular second connector element, said tubular first and second connector elements being coupled through said intermediate portion to provide an electrically conductive path;

means coupled to said first end portion for forming a projection in the form of a ring circumferentially extending around said first end portion and extending generally radially from said axis;

means coupled to said second end portion for forming a retaining member in the form of a ledge circumferentially projecting from said second end portion; and a second connector member coupled to receive said second end portion and including means for engaging said retaining member to form a cap over said second end portion and the second connector element received by said second end portion, said cap being constructed in the form of a tubular member having a first closed end and a second open end receiving said second end portion, and having a retaining groove which engages said retaining ledge of said second end portion to retain said cap on said second end portion, said projection and said second connector member being spaced from one another on opposite sides of said plate-like member to retain said intermediate portion within said opening, yet allow a predetermined movement of said first connector member in a direction parallel to said axis.

2. The connector assembly of claim 1 further including means for providing a biasing force between said cap and the second connector element when said cap is positioned to retain the second connector element in the second end portion of said connector assembly.

3. The connector assembly of claim 2 wherein said means for providing a biasing force comprises a foam pad.

4. A connector assembly for coupling a connector to a plate-like member having opposed sides and an opening through said plate-like member for receiving the connector assembly, the connector assembly comprising:

a first connector member having first and second end portions and an intermediate portion coupled between said end portions along an axis, said intermediate portion being configured to extend through said opening and spaced therefrom to allow movement of said intermediate portion in a radial direction relative to said axis, said first end portion being constructed and arranged to receive a first connector element and said second end portion being constructed and arranged to receive a second connector element, said first and second connector elements being coupled through said intermediate portion to provide an electrically conductive path;

means coupled to said first end portion for forming a projection extending generally radially from said axis;

means coupled to said second end portion for forming a retaining member; and a second connector member coupled to receive said second end portion and including means for engaging said retaining member to form a cap over said second end portion and the second connector element received by said second end portion, said second end portion and said cap each including a slot extending parallel to said axis, said slots cooperating to form an opening through which a portion of said second connector element extends when said second connector element is received by said second end portion and retained by said cap, said projection and said second connector member being spaced from one another on opposite sides of said plate-like member to retain said intermediate portion within said opening, yet allow a predetermined movement of said first connector member in a direction parallel to said axis.

5. The connector assembly of claim 4 wherein said means for forming a projection comprises a plurality of projections extending circumferentially from said tubular first end portion.

6. The connector assembly of claim 4 wherein said means for forming a retaining member comprises a plurality of projections, and said means for engaging said retaining member comprises a plurality of openings which slidably receive said projections to allow movement of said cap along said axis.

7. An assembly comprising:

a plate having a first side, a spaced opposed second side generally parallel thereto and a circular opening extending between said first and second side;

a tubular member having a first end portion, a second end portion, an intermediate portion coupled between said first and second end portions along an axis, a projection coupled to extend from said tubular member on said first end portion, and a retaining member extending from said second end portion, said tubular member being positioned within said opening such that said axis is generally perpendicular to said first and second sides and said intermediate portion is configured to be received within said opening and spaced therefrom such that said first and second end portions are adjacent opposite sides of said plate and said tubular member may move in a radial direction relative to said axis within said opening;

a tubular end cap having a closed end, an open end, and means for removably engaging said retaining member to hold said end cap on said second end portion, said end cap and said projection being spaced from one another and located on opposite sides of said plate and spaced from that adjacent side and configured to retain said intermediate portion within said opening yet allow movement of said tubular member in a direction parallel to said axis simultaneous with said radial movement, said first end portion receiving a first connector and said second end portion receiving a second connector which is retained by said end cap; and means for providing a bias force against said second connector which includes a foam pad interposed between said closed end of said end cap and said second connector.

8. The assembly of claim 7 wherein said second end portion and said end cap each include a slot extending parallel to said axis and said second connector includes a conductor coupled to said second connector and extending through each of said slots such that said slots allow movement of said second connector and conductor parallel to said axis.

* * * * *